US005601045A

United States Patent [19]

Bowers, Jr. et al.

[11] Patent Number: 5,601,045

[45] Date of Patent: Feb. 11, 1997

[54] SAILBOAT FLOTATION APPARATUS

[76] Inventors: Gordon G. Bowers, Jr., 15817 White Pine Dr., Wayzata, Minn. 55391; Bradley M. Robinson, 20614 Linwood Rd., Excelsior, Minn. 55331

[21] Appl. No.: 543,148

[22] Filed: Oct. 13, 1995

Related U.S. Application Data

[63] Continuation of Ser. No. 370,028, Jan. 9, 1995, abandoned.

[51] Int. Cl.[6] ..... B63H 9/04

[52] U.S. Cl. ..... 114/103

[58] Field of Search ..... 114/39.1, 39.2, 114/91, 89, 102, 103; 441/124, 125, 126, 127

[56] References Cited

U.S. PATENT DOCUMENTS

| | | | |
|---|---|---|---|
| 3,225,369 | 12/1965 | Berwick | 441/127 |
| 3,323,151 | 6/1967 | Lerman | 441/127 |
| 4,344,377 | 8/1982 | Gram | 114/39.1 |
| 4,461,231 | 7/1984 | Hoyt | 114/102 |

FOREIGN PATENT DOCUMENTS

| | | | |
|---|---|---|---|
| 2755991 | 6/1979 | Germany | 114/103 |
| 2835811 | 2/1980 | Germany | 114/103 |

*Primary Examiner*—Stephen P. Avila
*Attorney, Agent, or Firm*—Clayton R. Johnson

[57] ABSTRACT

A flotation hood removably extendable over the top portion of a main sail of a watercraft and being movable with the sail without being joined thereto. The hood includes a first and a second flotation panel section contained in pockets of an envelope on opposite sides of the sail, the envelope having a vertical web portion extending at least partially around the sail bolt rope to move vertically within the mast channel. Each panel section includes a plurality of plastic flotation panels that are connected together for hinged movement about predominantly vertically extending axes with the trailing edge of one panel being adjacent to the leading edge of a second panel. A shackle bolt is connected to a halyard and is extended through shackle bolt apertures in the sail and hood for hoisting the hood and sail.

24 Claims, 4 Drawing Sheets

SAILBOAT FLOTATION APPARATUS

This application is a continuation of application Ser. No. 08/370,028, filed Jan. 9, 1995 now abandoned.

BACKGROUND OF THE INVENTION

A flotation device usable for being mounted to aid in uprighting an capsizeed sailboat and/or preventing the sailboat completely capsizing.

In the prior art, as an aid in uprighting a partially or completely capsized, small sized watercraft, for example sailboats, various items have been attached to the upper end of the mast or main sail. For example plastic bottles, balloons, life jackets and foam panels have been used. Some of such prior art devices have undesirable drag surfaces and/or and undesirable amount of weight at the top of the sail. When foam panels have been used, two panels are used, one on each side of the sail and joined thereto. It is necessary to drop the sail and then the panels are attached to the sail by Velcro or zippers which, at least in part, had been previously attached to-the sail. In order to be able to use such panels with more than one sail, it is necessary that each sail be provided with the respective part of a zipper or Velcro fastener, i.e. modifying the sail. With reference to using more than one main sail, typically, in racing, one chooses between a lighter, medium and a heavier sail, depending upon weather conditions.

One of the disadvantages of using such prior art panels is that the panels are inflexible while the sail normally curves or flexes with the change in wind conditions during use. Another disadvantage is that at least part of the zipper or Velcro fastener has to be attached to the sail. With reference to using Velcro, at times when the boat tips, the wave action results in the Velcro attachment releasing and the benefit of having the panel attached to the sail is lost.

SUMMARY OF THE INVENTION

A flotation hood is shaped to be slipped over the top part of the main sail and is retained thereon, in part by the shackle bolt that attaches the halyard to the top of the main sail. The hood includes a first and a second flotation panel section, each panel section being able to flex (articulate) about a number of generally vertical axes and being located on the opposite side of the top part of a sail from the other. The panel sections are retained in pockets in a fabric envelope. Further, the envelope has a front (leading) portion extendable into the channel portion of the mast into which the sail bolt rope extends.

One of the objects of this invention is to provide new and novel flotation means that is removably mountable on the top part of the main sail of a sailboat without requiring any modification of the sail. Another object of the invention is to provide new and novel flotation means that can be slipped over the top part of a main sail while still allowing the top part of the sail to flex as the wind bends or flexes the adjacent part of the sail. Still another object of this invention is to provide new and novel flotation means that is articulatable to conform to the sail aerodynamic shape.

A different object of this invention is to provide new and novel flotation means for a sailboat that may be readily transferred from sail to sail. In furtherance of the last mentioned object, it is another object of this invention to provide new and novel flotation means that is readily extendable over the top part of a sailboat main sail and retained in place without being joined to the main sail. Still another object of this invention is to provide new and novel flotation means to prevent a small watercraft capsizing completely and thereby facilitating the crew of the craft uprighting the craft without outside assistance.

Figure 1:
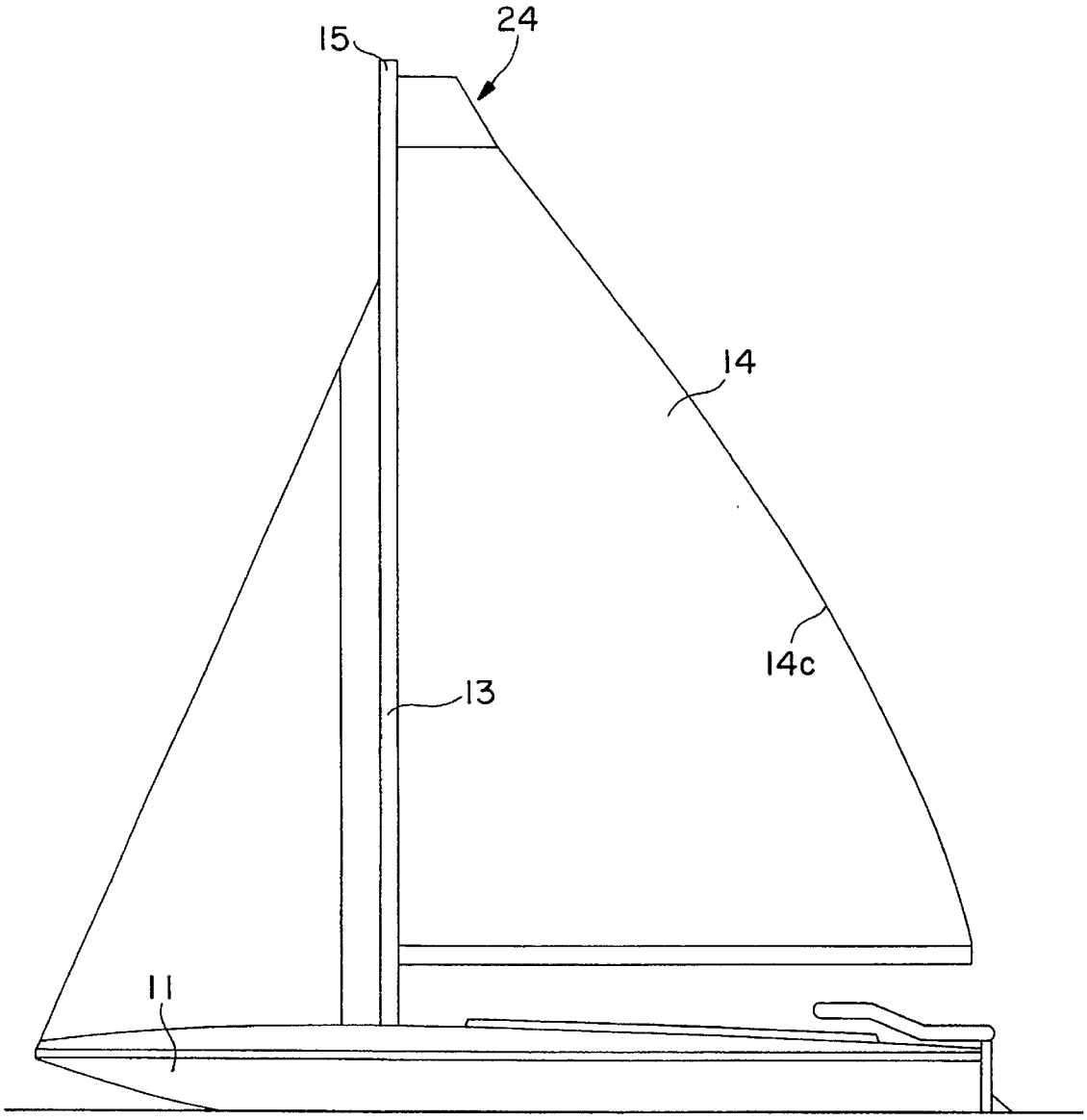
FIG. 1 is a side view of a sailboat having the flotation hood of this invention on the sail.
Figure 2:
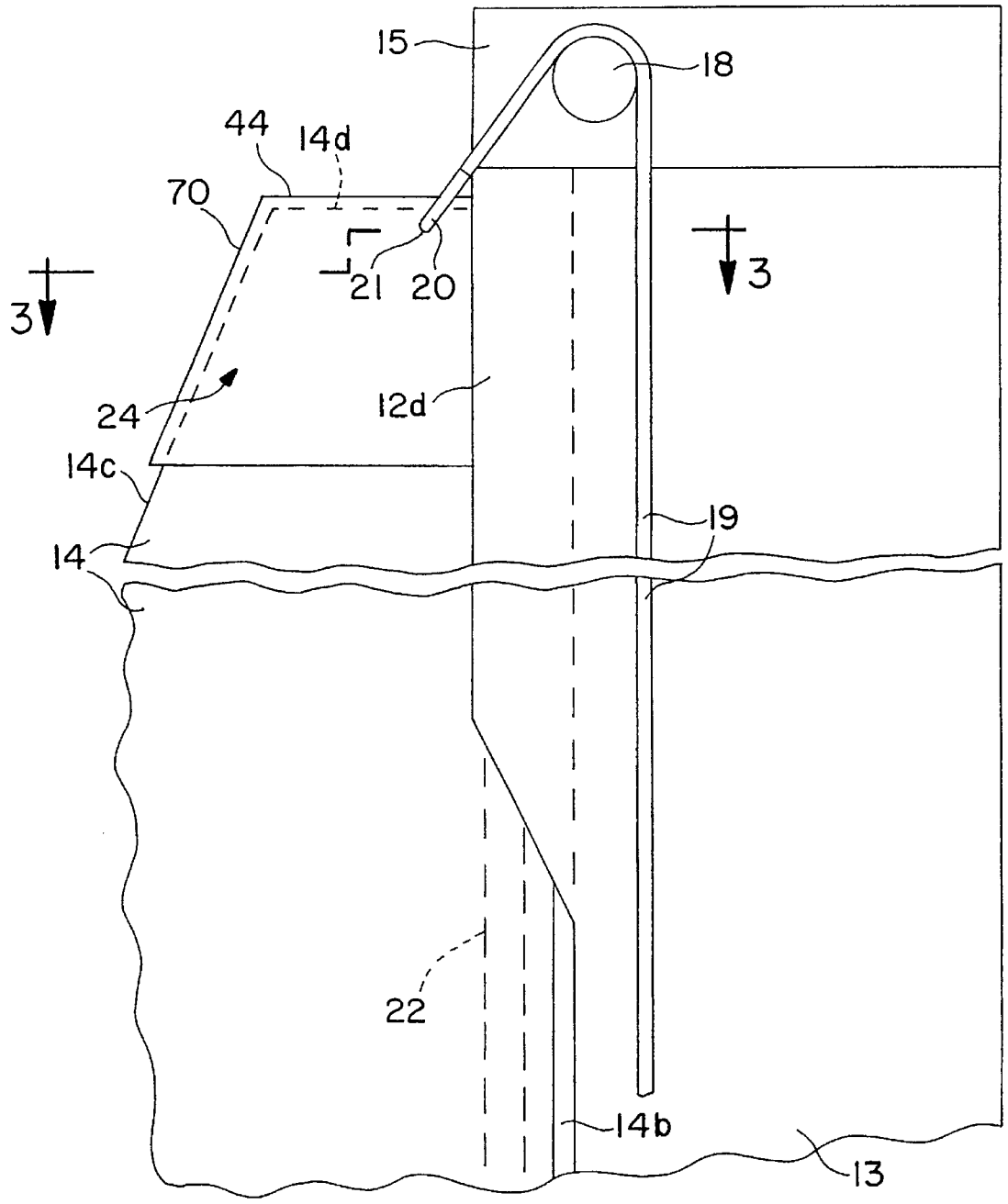
FIG. 2 is an enlarged fragmentary side view of the main sail and mast of the sailboat with the flotation hood thereon, a vertical intermediate portion being broken away.
Figure 4:
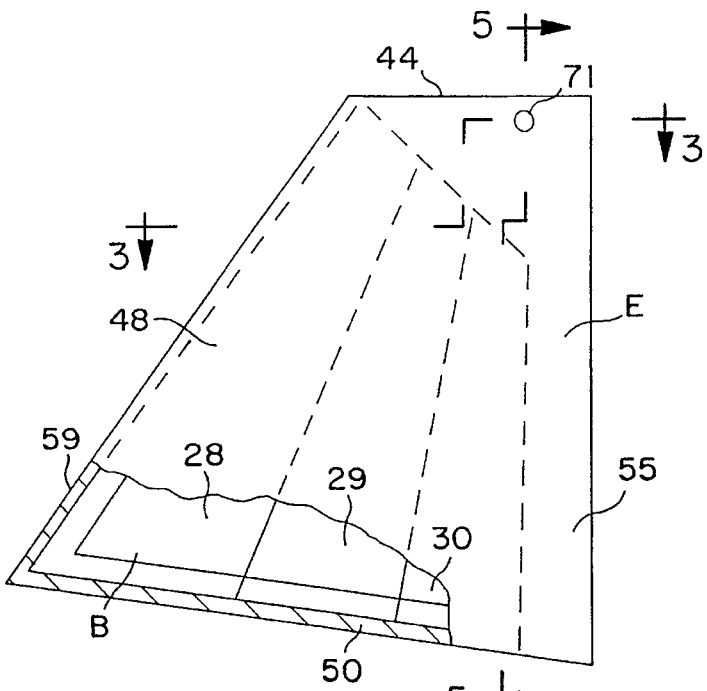
FIG. 4 is a side view of the flotation hood of this invention.

Referring in particular to FIGS. 1 and 2, there is shown a sailboat (small watercraft) having a hull 11, a mast 13 mounted to and extending above the hull, a top cap 15 mounted to the top end portion of the mast and a main sail 14. The halyard 19 extend up and over a pulley 18 that is mounted to the top cap 15 and has one end attached to the upper front portion of the main sail by a U-shackle 20 which extends through an aperture 21 in the head panel portion of the main sail.

Figure 3:
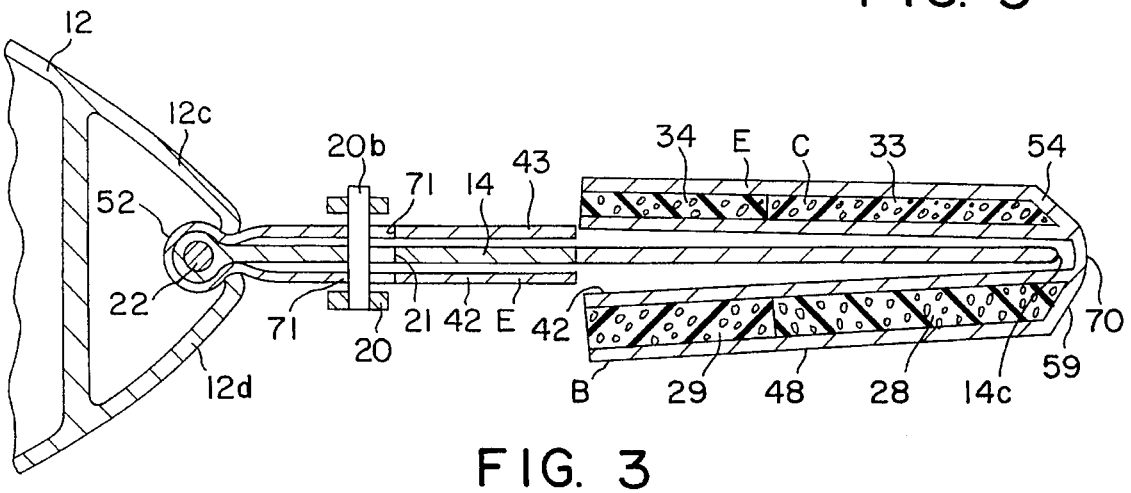
FIG. 3 is a cross sectional view that is generally taken along the lines and in the direction of the arrows 3—3 of FIGS. 2 and 4.
Figure 6:
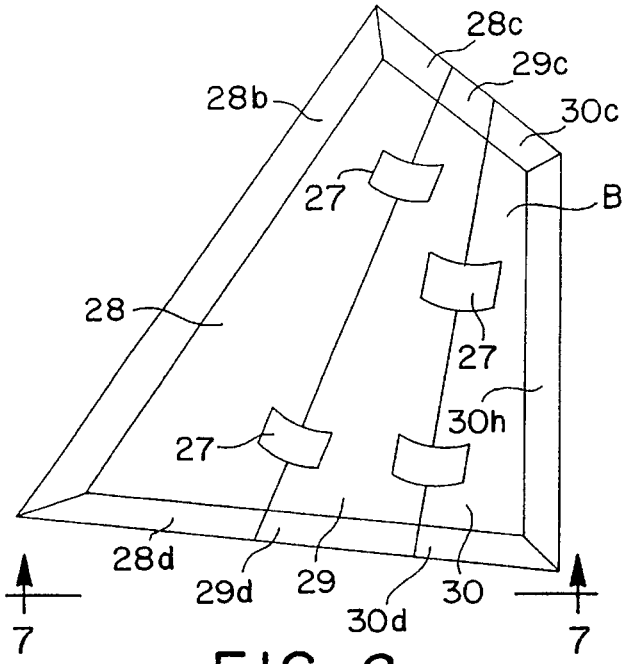
FIG. 6 is a side view of one of the flotation panel sections of the hood of this invention.
Figure 8:
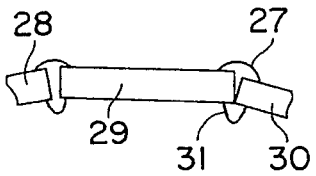
FIGS. 8 and 9 are fragmentary, somewhat diagrammatic views of one of the panel sections to illustrate the articulate or hinged feature thereof.
Figure 9:
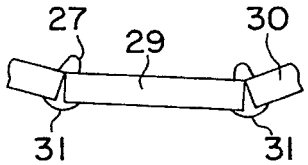
Figure 7:
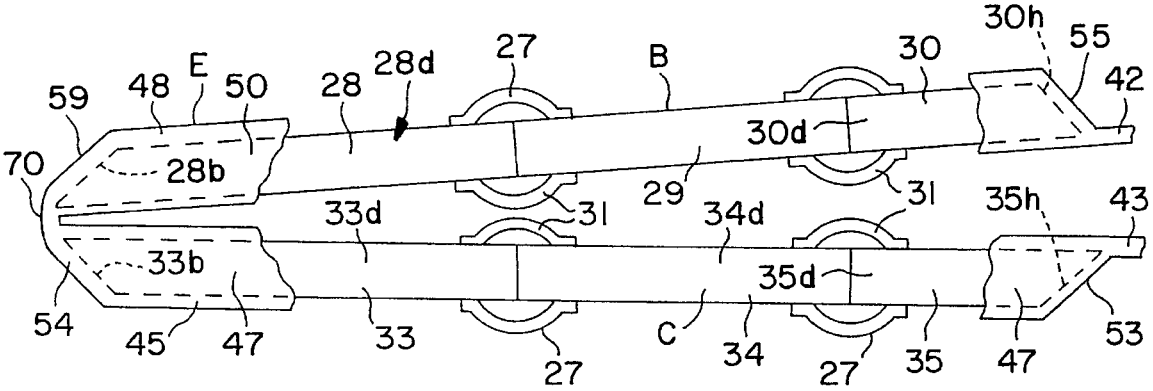
FIG. 7 is a bottom view of the panel sections of the hood of this invention together with parts of the envelope for containing the panel sections, said view being generally taken along the line and the direction of the arrows of FIG. 6.

The main sail has a front edge portion 14*b* extending around a bolt rope 22 in a conventional manner (also see FIG. 3), a trailing edge 14*c*, a top horizontal edge 14*d* and opposite sides. Thus the main body portion of the sail extends rearwardly of the channel. The mast has a pair of vertically elongated channel legs 12*c*, 12*d*that converge toward one another in a rearward direction to form a channel having a rearwardly opening vertical channel slot that extends downwardly from adjacent to the top cap to a short distance above the hull and has the sail front edge portion extended therethrough. The channel legs at their lower ends terminate at a conventional distance above the hull. The width of the slot (minimum horizontal distance between the adjacent terminal ends of the channel legs) is less than the diameter of the bolt rope. That is, the minimum horizontal dimension of the channel slot is less than the maximum horizontal cross section of the bolt rope. Instead of the channel and channel slot being formed as a part of the mast, it is to be understood the channel may be provided by having a separate channel strip mounted to the mast.

The flotation hood of this invention, generally designated 24, includes a pair of articulated panel sections designated B and C respectively. Each panel section includes at least two panels and desirably three or more, the illustrated panel section B including vertically elongated, trailing, intermediate and leading panels 28, 29 and 30 respectively, and the illustrated panel section C including vertically elongated, trailing, intermediate and leading panels 33, 34 and 35 respectively. Each of the panels has a leading and a trailing edge with the leading edge of the intermediate panel being adjacent to the trailing edge of the leading panel and the trailing edge being adjacent to the leading edge of the trailing panel. The leading edge 35*h* of the leading panel 35 extends substantially vertically while the trailing edge of the leading panel and the leading edge of the intermediate panel 34 extend at supplemental angles and extend predominately upwardly at an angle to converge toward the leading edge of the leading panel. Similarly, the leading edge of the trailing panel 33 and the trailing edge of the intermediate panel 34 extend at supplemental angles relative to one another and extend predominantly upwardly toward the leading edge of the leading panel at a greater angle than the leading edge of the intermediate panel and the trailing edge of the leading panel. Advantageously, the leading edge of the leading panel 35 extends substantially parallel to the mast while the trailing edge 33*b* of the trailing panel 33 extends predominately vertically upwardly and horizontally toward the mast when the hood is in use. Since the panel sections are mirror images of one another, for the most part only panel section B will be described.

Advantageously, each of the flotation panels 28–30 and 33–35 is of a trapezium shape with their bottom edges extending generally horizontally, and their top edges extending progressively downwardly in a forward direction (direction toward the mast) and being of a smaller dimension than the bottom edges. Panels 28, 29 are hingedly connected together on opposite sides thereof by upper and lower hinged strips 27, 31 respectively joined to opposite sides of the panels with the panel adjacent generally vertical edges in abutting or near abutting relationship. Similarly, panels 29, 30 are hingedly connected together by upper and lower hinged strips 27, 31 respectively with the panel adjacent generally vertically extending edges in abutting or near abutting relationship. The hinge strips connect the panels together for hinged or articulated movement about axes that extend predominantly vertically. Although not essential, advantageously, the panels are of the same thickness, except for the tapered parts referred to below, and opposite sides parallel to one another.

The flotation hood also includes an envelope E for containing the flotation panel sections B and C. The envelope is made of a flexible material, for example of a material that is of substantially the flexibility as that of the sail. The envelope, when in a position of use, includes adjacent vertical side portions 42, 43 that joined by a top web portion 44 extending between their top edges. Further, the a vertical, leading web portion 52 joins the leading parts of the side portions 42, 43 to one another. Side portion 42 in conjunction with side portion 48, opposite leading and trailing vertical web portions 55, 59, horizontal bottom edge portion 50 and a top forwardly and downwardly extending web portion 57 are suitably joined together to form a pocket having the panel section B therein. Similarly, side portion 43 in conjunction with side portion 45, opposite leading and trailing vertical web portions 53, 54, horizontal bottom edge portion 47 and a top forwardly and downwardly extending web portion 58 are suitably joined together to form a pocket having the panel section C therein. The envelope side portions extend down along side of the panel sections. Even though not shown, each of the bottom web portions may be provided with a zipper or other suitable mechanism to permit removing or replacing panel sections.

The envelope web portions 54, 59 are joined together by a web portion 70. The vertical angles of extension of the web portions 52, 70 and the fore and aft spacing of web portions 52, 70 is sufficiently great that the envelope may be easily slipped over the top of the main sail and permit the flexing of the panels 33–35 and 28–30 relative to one another as the main sail bows as the result of the wind. When the flotation hood has been properly extended (slipped) over the main sail, the hood apertures 71 in the upper envelope side wall portions 42, 43 are aligned with the main sail aperture 21 to have the shackle bolt 20b of the shackle 20 extended through said apertures. The apertures 71 are located above the panels 30, 35 and forwardly of the panels 28, 33 to permit flexing of the hood without flexing of the panels while not preventing the flexing of any one of the panels.

Figure 5:
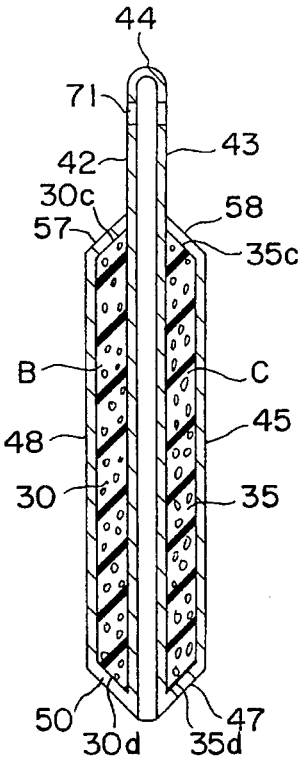
FIG. 5 is a vertical cross sectional view that is generally taken along the line and in the direction of the arrows 5—5 of FIG. 4.

In a horizontal direction, advantageously, the leading and trailing edges of the intermediate panel 29, the leading edge of the trailing panel 28 and the trailing edge of the leading panel 30 extend perpendicular to the panel side surfaces. Further, advantageously, the trailing edges 28*b*, 33*b* of the trailing panels 28, 33 respectively are tapered to converge toward one another in a direction away from the mast while the leading edges 3O*h*, 35*h* of the panels 30, 35 converge toward one another in a forward direction (direction toward the mast). The top edges of the panels of the panel sections B, C respectively converge toward one another in an upward direction. That is, the top edges 28*c*, 29*c*, 30*c* of panels 28, 29, 30 respectively are advantageously tapered to substantially be in a common plane while the top edges of the panels 33–35 are correspondingly tapered, but of an oppositely taper such as shown in FIG. 5 for top edges 30*c*, 35*c* of panels 30, 35 respectively. Similarly, the bottom edges 28*d*, 29*d*, 30*d* of panels 28, 29, 30 respectively are advantageously tapered to substantially be in a common plane while the bottom edges 33*d*, 34*d*, 35*d* of the panels 33–35 are correspondingly tapered, but of an oppositely taper such as shown in FIG. 5 for bottom edges 30*d*, 35*d* of panels 30, 35 respectively. The bottom tapered edges of the panels of panel sections B, C respectively converge downwardly toward one another. The envelope top web portions 57, 58 extend at substantial the same angles as the top edges of the panel portions and are in abutting or close to abutting relationship to the panels sections. Similarly, envelope bottom web portions 47, 50 extend at substantially the same angles as the bottom tapered edges of the panel portions and are in abutting or close to abutting relationship to the panel sections. Also, the leading and trailing web portions 55, 53, 59 and 54 extend at substantially the same angles as the tapered leading and trailing tapered edge 30*h*, 35*h*, 28*b*, 33*b* edges of the panel portions and are in abutting or close to abutting relationship to the panel sections.

To use the hood, with the main sail lowered, the hood is slipped over the upper end portion of the main sail. Then the shackle bolt is extended through apertures 21, 71 and the halyard used to hoist the main sail. As the main sail is hoisted, the forward end portion of the main sail, including the bolt rope, and the hood portion 52 are guided to enter into the lower open end of the channel defined by legs 12*c*, 12*d*. As may be noted from FIG. 3, the envelope leading edge portion extends through at least a 180° arc around the leading edge portion (including the bolt rope) of the sail. When the main sail is fully hoisted, the hood is retained on the main sail merely by having the web portion 52 extending partially around the bolt rope within the channel 12*c*, 12*d* and the shackle bolt extended through the envelope apertures 71. Thus the flotation hood is not fixed to or connected to the main sail, but rather merely removably slipped over the upper part of the main sail.

The height and thickness of the flotation panels would be selected on the basis of the flotation required to prevent the mast remaining in a vertically downward position in the event the sailboat capsizes (capsizes). Further, even though the flotation device of this invention has been described with reference to sailboats, it is to be understood it can be used with other small sailing watercraft, for example a catamarans.

Even though the main sail as illustrated has a generally horizontal top edge 14*d* and accordingly the hood having a generally horizontal top edge web portion 44, it is to be understood that the top portion of the main sail may be generally triangular and accordingly that the flotation hood in side view may be generally triangular instead of trapezial. If the hood was generally triangular, the top edges of the panels would be appropriately modified with the top edges being entirely below the hood shackle bolt aperture.

Further, even though the channel 12*c*, 12*d* is shown as being integrally formed as part of the mast, it is to be understood that a channel (not shown) having a web portion may be conventionally generally triangular, the top edges of the panels would be appropriately modified with the top edges being entirely below the hood shackle bolt aperture.

Further, even though the channel 12*c*, 12*d* is shown as being integrally formed as part of the mast, it is to be understood that a channel (not shown) having a web portion may be conventionally attached to the mast and would be a member separate and distinct from the channel. The panels are preferably made of a plastic closed foam material, for example styrofoam or similar rigid material.

What is claimed is:

1. A sail that is adapted for use with a watercraft such as a sail boat which has a mast and is movable relative to the mast between a hoisted position and a lowered position in combination with a flotation device, said sail having a top portion that has opposite sides, said floatation device comprising a first and a second panel section, each panel section including a plurality of floatation panels having opposite edges and means for hingedly connecting each panel to the adjacent panel in edge to edge relationship, each panel belong made of a rigid material that will float in water, and an envelope adapted to slip over the sail top portion and having a first and a second pocket for respectively containing the first and second panel sections and respectively retaining the first and second panel sections on the opposite sides of the sail.

2. The flotation device of claim 1 wherein each pocket has a leading edge portion and an opposite trailing edge portion, and the envelope has a vertically extending leading web portion and a vertically extending trailing web portion joining the first and second pocket leading edge portions to one another.

3. The flotation device of claim 2 wherein the envelope has a bottom opening that opens between the pockets, and a top web portion opposite the bottom opening and extending between the pocket leading and trailing web portions.

4. The flotation device of claim 3 wherein the envelope has a shackle bolt aperture spaced from the panel sections and each of the said panel opposite edges extends predominantly vertically.

5. The flotation device of claim 3 wherein the plurality of panels of each panel section includes a leading first, an intermediate second and a trailing third vertically elongated panel, the said opposite edges of each of the panels comprising a vertically extending leading edge and a vertically extending trailing edge, the second panel leading edge being adjacent to the first panel trailing edge and the second panel trailing edge being adjacent to the third panel leading edge.

6. The combination of a sail that includes a top portion having opposite sides and is adapted for use with a watercraft such as a sail boat which has mast and is movable relative to the mast between a hoisted position and a lowered position; and a flotation device comprising a first and a second panel section, each panel section including a plurality of floatation panels that includes a leading first, an intermediate second and a trailing third vertically elongated panel, each of said panels having opposite edges, said opposite edges of each of the panels includes a predominantly vertically extending leading edge and a predominantly vertically extending trailing edge, the second panel leading edge being adjacent to the first panel trailing edge and the second panel trailing edge being adjacent to the third panel leading edge, the leading and trailing edge of each of the intermediate panels and the trailing panel converging toward the leading panel leading edges in a vertically upwardly extending direction, and means for hingedly connecting each panel to the adjacent panel in edge to edge relationship, each panel being made of a rigid material that will float in water, and an envelope adapted to slip over the sail top portion and having a first and a second pocket for respectively retaining the first and second panel sections on the opposite sides of the sail, each pocket having a leading edge portion and an opposite trailing edge portion, the envelope having a vertically extending leading web portion and a vertically extending trailing web portion joining the first and second pocket leading edge portions to one another, a bottom opening that opens between the pockets, and a top web portion opposite the bottom opening and extending between the pocket leading and trailing edge portions to one another.

7. The flotation device of claim 6 wherein each of the panels has a top edge and a bottom edge, the bottom edges of the panels of the first panel section and second panel section being tapered to converge toward one another in a downward direction, the trailing edges of the trailing panels being tapered in a direction to converge toward one another in a direction away from the leading edges of the trailing panels and the leading edges of the leading panels being tapered in a direction away from the trailing edges of the leading panels.

8. The combination of a small watercraft having a mast, a vertically elongated bolt rope channel joined to the mast and having a vertical channel slot opening opposite the mast, a main sail having a leading bolt rope edge portion extendable within and vertically movable within the channel to retain the main sail adjacent to the mast, a trailing edge and opposite sides, and halyard means mounted to the mast for moving the main sail from a lowered position to a hoisted position, said sail having a top end portion; and a flotation hood removably slippable over the sail top portion for facilitating the uprighting of a capsizeed watercraft, said watercraft including a first and a second flotation panel section, each of the panel sections including a vertically elongated leading panel, a vertically elongated trailing panel, at least one vertically elongated intermediate panel, the at least one intermediate panel being disposed between and adjacent to the trailing and leading panels, each of the panels having elongated vertically extending leading and trailing edges, first hinge means connecting the leading panel to the adjacent intermediate panel with the leading panel trailing edge being adjacent to the adjacent intermediate panel leading edge for hinged movement about a vertically extending axis, and second hinge means for connecting the trailing panel to the adjacent intermediate panel with the leading panel trailing edge being adjacent to the trailing edge of the last mentioned intermediate panel for hinged movement about a vertically extending axis, the halyard means including a halyard and means for connecting the halyard to the flotation hood for hoisting the flotation hood with the main sail, the sail top portion extending between the first and second panel sections, each of said panels being made of a material that is of a density substantially less than that of water.

9. The combination of claim 8 wherein the flotation hood includes a flexible envelope having a top portion, a first pocket for containing the first panel section, a second pocket for containing the second panel section, and an open bottom opening between the pockets, the envelope being extendable over the sail top portion with the main sail extending downwardly through the envelope open bottom.

10. The combination of claim 9 wherein each panel is of a greater maximum vertical dimension than its maximum width dimension and of a maximum width dimension that is greater than its maximum thickness.

11. The combination of claim 9 wherein the sail has a main body portion trailing the bolt rope portion, and the channel slot extends vertically to open away from the mast and is of a narrower horizontal dimension than the maximum horizontal cross section than the maximum horizontal cross section of the bolt rope portion.

12. The combination of claim 9 wherein the sail top portion has a shackle bolt aperture, the envelope top portion has a shackle bolt aperture and the means for connecting the halyard to the flotation hood includes a shackle bolt extended through the shackle bolt apertures.

13. The combination of claim 12 wherein the envelope aperture is at least one of vertically and horizontally spaced from the panel sections.

14. The combination of a small watercraft having a mast, a main sail having a leading edge, a trailing edge and opposite sides, and halyard means mounted to the mast for moving the main sail from a lowered to a hoisted position, said sail having a top end portion; and a flotation hood removably slippable over the sail top portion for facilitating the uprighting of a capsizeed watercraft that includes a first flotation panel section, the panel section including a vertically elongated leading panel, a vertically elongated trailing panel, each of the panels having elongated vertically extending leading and trailing edge portions and being made of a rigid plastic material that will float in water, the panel leading and trailing edge portions respectively having leading and trailing edges, means for connecting the leading panel trailing edge portion to the trailing panel leading edge portion with the trailing panel leading edge being intermediate the trailing panel trailing edge and the leading panel trailing edge for hinged movement about at least one vertically extending axis, the halyard means including a halyard and means for connecting the halyard to the flotation hood for hoisting the flotation hood with the main sail.

15. The combination of claim 14 wherein the flotation hood includes a flexible envelope having a pocket for containing the panels adjacent to the sail top portion while permitting hinged movement of the panels relative to one another, the envelope having a shackle bolt aperture remote from the panels, and the means for connecting the halyard includes a shackle bolt extended through said aperture.

16. The combination of claim 15 wherein the flotation hood includes a second panel section, the second panel section including a vertically elongated leading second panel, a vertically elongated trailing second panel, each of the second panels of the second panel section having elongated vertically extending leading and trailing edge portions and being made of a rigid plastic material that will float in water, the second panel leading and trailing edge portions respectively having leading and trailing edges, means for connecting the leading second panel trailing edge portion to the trailing second panel leading edge portion with the second trailing panel leading edge being intermediate the second leading panel and the second trailing panel trailing edge for hinged movement about at least one vertically extending axis, and the envelope has a second pocket for containing the second panel section on the opposite side of the sail top portion from the first panel section.

17. The combination of claim 14 wherein the means for connecting the panels for hinged movement includes an intermediate panel having a vertically extending trailing edge adjacent to the trailing panel leading edge and means for connecting the intermediate panel to the trailing panel for hinged movement about at least one predominantly vertically extending axis.

18. The combination of a small watercraft having a mast, a vertically elongated bolt rope channel joined to the mast and having a vertical channel slot opening opposite the mast, a main sail having a leading bolt rope edge portion extendable within and vertically movable within the channel to retain the main sail adjacent to the mast, a trailing edge and opposite sides and halyard means mounted to the mast for moving the main sail from a lowered position to a hoisted position, said channel slot extending vertically to open away from the mast and being of a narrower horizontal dimension than the maximum horizontal cross section of the leading bolt rope edge portion, said sail including a top end portion; and a floatation hood removably slippable over the sail top end portion for facilitating the uprighting of a capsized watercraft, said floatation hood including a first panel section made of a material that will float in water and a flexible envelope removably slippable over the sail top portion to extend on opposite sides of the sail for containing the panel section adjacent to the sail top end portion, the envelope having a bottom opening to have the sail extend downwardly therethrough and a vertically extending leading web portion extending within the channel and through at least an 180 degree arc around the leading bolt rope edge portion.

19. The combination of claim 18 wherein the sail top portion has a shackle bolt aperture, the envelope has a top portion, the envelope top portion having top portion a shackle bolt aperture, the envelope shackle bolt aperture being at least one of vertically and horizontally spaced from the panel section, and the halyard means includes a shackle bolt extended through the shackle bolt apertures.

20. The combination of claim 18 wherein the envelope includes vertically opposite sides that extend on opposite sides of the sail and a top web portion opposite the bottom opening and joined to the envelope opposite sides, the envelope leading web portion is joined to the envelope vertically opposite sides, and the pocket includes a vertical side that in part is defined by one of the envelope opposite sides and a second side.

21. The combination of claim 18 wherein the floatation hood includes a second panel section, the envelope contains the second panel section on the opposite side of the sail from the first panel section.

22. The combination of claim 21 wherein each of the panel sections include a plurality of floatation panels having opposite edges and means for hingedly connecting each panel to the adjacent panel in edge to edge relationship, each panel being made of a rigid plastic material that will float in water.

23. The combination of claim 21 wherein the envelope includes a first and a second pocket for respectively retaining the first and second panel section on the opposite sides of the sail with the bottom opening opening between the pockets.

24. The combination of claim 23 wherein the envelope includes vertical sides and a top web portion opposite the bottom opening and joined to each envelope side, the envelope leading web portion is joined to the envelope vertical sides, and each pocket includes a vertical side that in part is defined by the respective envelope side.

* * * * *